United States Patent [19]

Mount et al.

[11] Patent Number: 4,984,431

[45] Date of Patent: Jan. 15, 1991

[54] HIGH EFFICIENCY PURGE SYSTEM

[75] Inventors: Gordon L. Mount, W. Monroe; James N. Cuny, Manlius, both of N.Y.

[73] Assignee: Carrier Corporation, Syracuse, N.Y.

[21] Appl. No.: 540,954

[22] Filed: Jun. 20, 1990

[51] Int. Cl.[5] ..... F25B 47/00

[52] U.S. Cl. ..... 62/85; 62/475

[58] Field of Search ..... 62/85, 475

[56] References Cited

U.S. PATENT DOCUMENTS

| | | | |
|---|---|---|---|
| 2,577,598 | 12/1951 | Zwickl | 62/475 |
| 2,971,352 | 2/1961 | Parker | 62/475 |
| 2,986,905 | 6/1961 | Kocher et al. | 62/475 |
| 3,013,404 | 12/1961 | Endress et al. | 62/475 X |
| 3,357,197 | 12/1967 | Massengale | 62/475 X |
| 4,304,102 | 12/1981 | Gray | 62/475 X |

*Primary Examiner*—Lloyd L. King

*Attorney, Agent, or Firm*—Dana F. Bigelow

[57] ABSTRACT

In order to enhance the efficiency of removing refrigerant from the mixture of non-condensable gases in a purge recovery system, a carbon filter is placed in the flow of mixed gases from the purge chamber such that any remaining refrigerant can be absorbed by the filter and not be vented to the atmosphere with the non-condensable gases. The filter is periodically reactivated by the operation of a vacuum pump to remove the refrigerant from the carbon filter and return it to the system refrigeration circuit. The reactivation process is initiated and controlled by way of a pressure switch and a timer.

17 Claims, 2 Drawing Sheets

HIGH EFFICIENCY PURGE SYSTEM

BACKGROUND OF THE INVENTION

This invention relates generally to refrigeration systems and, more particularly, to purge recovery systems for removing non-condensable gases from the refrigeration circuit thereof.

By removing water and non-condensable gases such as air from refrigeration systems, purge units improve refrigeration efficiency by ensuring that condenser pressure is not artificially high due to the presence of non-condensables.

Such a purge unit commonly concentrates air from the refrigeration system by using the temperature difference between the evaporator and the condenser (i.e. thermal purge). Refrigerant containing a small amount of air is bled from the condenser, through an orifice and into a small chamber containing a cooling coil which is maintained at the temperature of the evaporator by flashing refrigerant liquid from the condenser down to the evaporator temperature. As the refrigerant condenses and drains back to the evaporator through a float valve, the air remains in the purge chamber and becomes concentrated. As the air accumulates, the pressure increases, and eventually the air is evacuated by way of a small vacuum pump. With such a process it is difficult to entirely remove the refrigerant from the non-condensable gases by way of the condensation process and, as a result, there is some refrigerant that is released to the atmosphere along with the non-condensable gases. Not only is this a waste of refrigerant which must eventually be replaced, but it also contributes to the undesirable emissions to the earth's atmosphere.

One known method of increasing the efficiency of the condensation process in the purge chamber is that of using a compressor to increase the pressure in the purge chamber. This has the effect of allowing more refrigerant to condense and thereby leaving a lower concentration of refrigerant in the non-condensable gases that are vented to the atmosphere. However, this enhancement concept is somewhat limited by the practical considerations of the relatively high pressures that are necessary in order to obtain complete condensation of all the refrigerants in the purge chamber.

It is therefore an object of the present invention to provide an improved purge recovery system for a refrigerant circuit.

Another object of the present invention is the provision in a purge recovery system for decreasing the percentage of refrigerant that is trapped within the non-condensable gases that are released to the atmosphere.

Yet another object of the present invention is the provision in a purge recovery system for enhancing the recovery of refrigerant in the purging process.

Yet another object of the present invention is the provision in a refrigeration system for a purge recovery system that is economical to manufacture and effective and efficient in use.

These objects and other features and advantages become more readily apparent upon reference to the following description when taken into conjunction with the appended drawings.

SUMMARY OF THE INVENTION

Briefly, in accordance with one aspect of the invention, a contained carbon filter is introduced into the venting circuit such that the discharge of gases from the purge chamber passes into the charcoal filter where refrigerant is absorbed. Eventually the non-condensable gases are released from the filter container and the container is then pumped down to remove the refrigerant from the filter and return it to the refrigeration circuit.

In accordance with another aspect of the invention, a compressor is employed to increase the pressure in the purge chamber and thereby increase the amount of refrigerant that it condenses. The purge chamber is then vented by way of a pressure activated relief valve to the carbon filter container. This container is, in turn, allowed to vent the non-condensable gases by way of a solenoid valve as the pressure reaches a predetermined level in the container. The activated carbon container is then periodically vented back to the evaporator so as to reactivate the carbon filter. The degree of activation can be enhanced by the use of a vacuum pump. Further, an electric heater may be used to further enhance the reactivation process.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
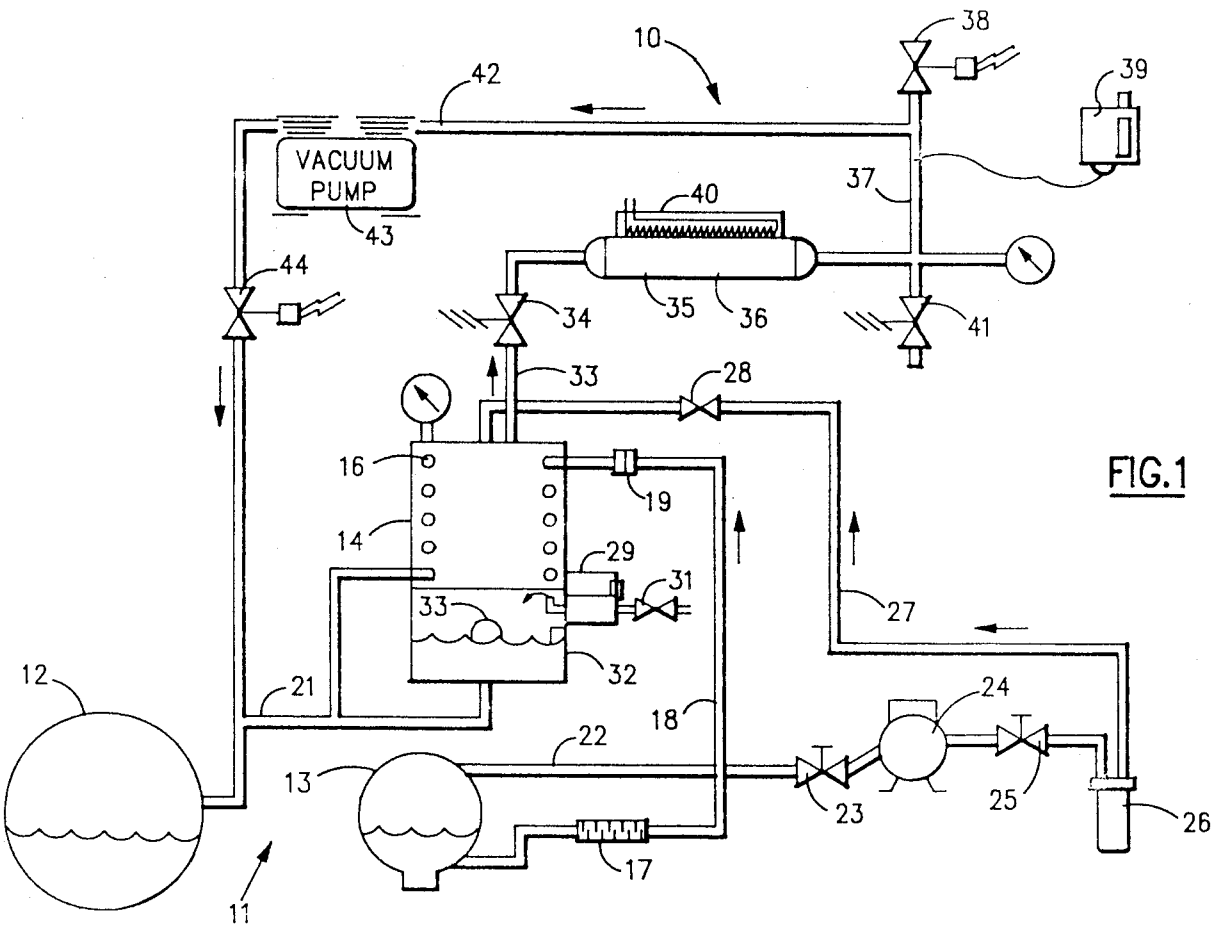
FIG. 1 is a schematic illustration of a typical refrigeration system with the present invention incorporated therein.

Referring now to FIG. 1, the invention is shown generally at 10 as incorporated into a purge system 11 of a refrigeration circuit which includes an evaporator or cooler 12, a condenser 13, and a purge chamber 14. The cooler 12 and condenser 13 are installed in a conventional manner to form a part of a refrigeration circuit (not shown) which includes an expansion device for introducing refrigerant vapor into the cooler 12 and a compressor which then compresses the heated vapor coming from the cooler 12 before it passes on to the condenser 13.

The purge chamber 14 contains a condensing coil 16 which operates in a somewhat conventional manner to cool the mixture of non-condensable gases and the condensable refrigerant such that the refrigerant is condensed and thereby separated from the non-condensable gases. The condensing coil 16 is cooled by way of refrigerant that passes from the condenser 13, in the liquid form, through a filter 17 and a conduit 18 to an orifice 19 where it is flashed into vapor which then flows through the condensing coil 16 where it performs a cooling function and then passes along conduit 21 to the cooler 12.

The refrigerant needing to be purged of air originates in the condenser 13 from which the refrigerant, together with the mixture of non-condensable gases and water vapor, passes from the condenser 13 along the conduit 22, valve 23, and compressor 24, where the pressure of the gas mixture is increased to about 40 psi. It then passes to a valve 25, an oil separator 26, a mixed gas input line 27, a valve 28, and finally to the purge chamber 14. Since most of the gas mixture is condensable and is at the approximate temperature of (and at a higher pressure than) the cooler 12, water vapor and refrigerant gas will condense and fall to the bottom of the purge chamber 14. Since the water is lighter than the refrigerant, it will separate in an upper compartment 29 from which it can be drawn off through valve 31. The heavier refrigerant passes into a lower float chamber 32, and as the refrigerant level in the chamber rises, a float valve 33 is automatically opened to allow the liquid refrigerant to pass along line 21 to the cooler 12.

At the top of the purge chamber 14 is a mixed gas discharge line 33 leading to a 40 psi relief valve 34 and hence to a filter tank 36. The filter tank 36 is filled with an absorbent carbon material 35 which functions to absorb any refrigerant that may remain in the mixed gas flowing from the discharge line 33. A material that has been found suitable for use in the filter tank 36 is a granulated activated carbon, type BPL-F3, which is, commercially available from Calgon Carbon Corporation. At the discharge end of the carbon tank 36 is a conduit 37 leading to an air vent solenoid valve 38. Operatively installed in the discharge line 37 is a pressure switch 39 which is operable to open the air vent solenoid valve 38 when the pressure in the discharge line 37 reaches a predetermined level, such as 10 psi. For safety purposes a relief valve 41 is provided at the other end of the discharge line 37 and is set at a higher pressure, such as 15 psi, so that in the event the pressure switch 39 and solenoid valve 38 fails to operate, the relief valve 41 will eventually come into play.

Also connected to the discharge line 37 by line 42 is a vacuum pump 43 leading to a solenoid valve 44 and finally to the conduit 21 leading back to the cooler 12. Its purpose is to reactivate the carbon filter in a manner to be described hereinafter. A heater 40 may be operatively attached to the filter tank 36 as shown to enhance the reactivation process.

Figure 2:
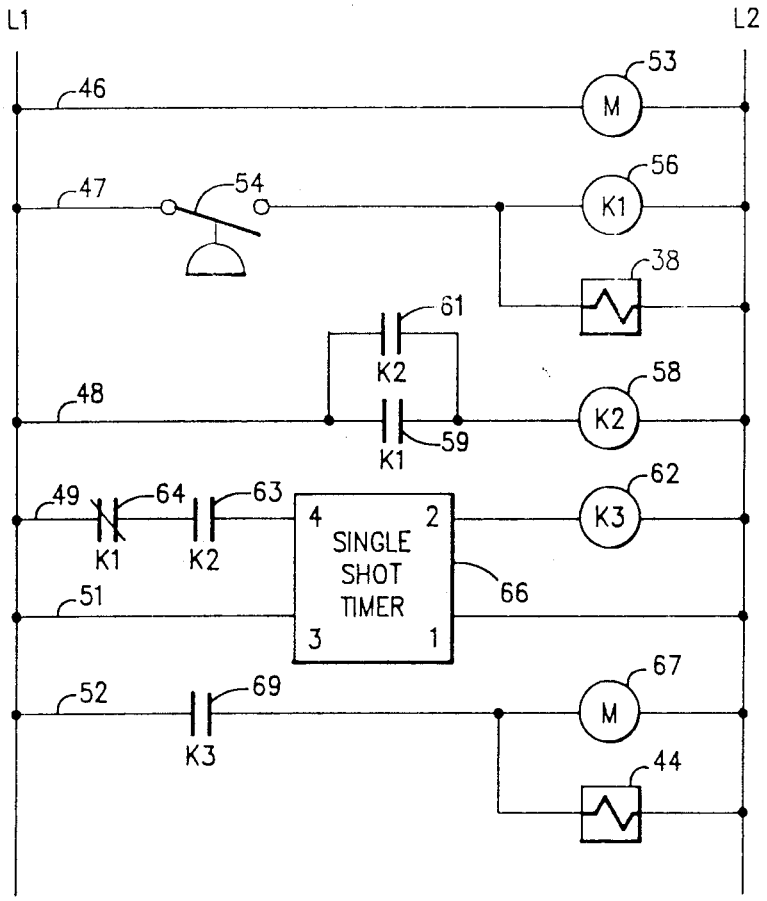
FIG. 2 is a schematic illustration of the electrical control circuit therefor.

Referring now to FIG. 2, the electrical control circuitry is shown in schematic form to include lines 46,47,48,49,51 and 52 in parallel between power leads L1 and L2, which are automatically energized whenever the machine compressor is in the operating condition. The motor 53 for the compressor 24 is connected in line 46. In line 47, the pressure switch contacts 54 of pressure switch 38 are in series with the K1 relay coil 56, which in turn is in parallel with the vent solenoid valve 38. In line 48, the K2 relay coil 58 is in series with the K1, normally open, relay contacts 59, which in turn has the K2, normally open, relay contacts 61 in parallel therewith. In line 49 the K3 relay coil 62 is in series with the K2, normally open, contacts 63 and the K1, normally closed, relay contacts 64. A single shot timer 66 is connected across lines 49 and 51 as shown. Finally, the motor 67 for the vacuum pump 43 is connected in line 52, in series with the K3, normally open relay contacts 69 and in parallel with the solenoid valve 44.

In operation, the compressor motor 53 continually runs whenever the machine compressor is in operation, to pull refrigerant vapor with mixed non-condensable gases from the machine condenser 13 by way of line 22 to thereby pressurize the purge chamber 14. As air accumulates, the pressure in the purge chamber 14 rises until the relief valve 34 opens (e.g. at 40 psi) thereby allowing the pressurized refrigerant/non-condensable gas mixture to flow into the carbon container 36. The carbon 35 in the container 36 absorbs the refrigerant vapor and the accumulating air increases the pressure in the container 36. When the pressure reaches a predetermined level (e.g. 10 psi), the pressure switch contacts 54 close to thereby energize the air vent solenoid 38 to vent the air and to activate the K1 relay coil 56. In turn, the K1, normally open, relay contacts 59 are caused to close to thereby energize the K2 relay coil 58, and the K1, normally closed, contacts 64 in line 49 are caused to open. Activation of the K2 solenoid coil 58, in turn, closes the K2, normally open, contacts 61 and 63. At this point, the lines 47, 48 and 51 have completed circuits and the lines 49 and 52 have open circuits.

Because of the air vent solenoid 38 being opened to vent the air from the carbon tank 36, the pressure in the tank eventually drops to 1 psi, which causes the pressure switch contacts 54 to open to thereby inactivate the K2 relay coil 56. This, in turn, opens the K1 relay contacts 59 and closes the K1 contacts 64 to thereby start the single shot timer 66 and activate the K3 relay coil 62. The K3, normally open, contacts 69 then close to activate the vacuum pump motor 67 and the solenoid valve 44. The cycle timer 66 is then set to run for 10 minutes, during which time the vacuum pump 43 proceeds to draw down the pressure in the tank 36 from the 1 psi condition to a vacuum of about 27 in. of mercury to scavange the refrigerant vapors that have been trapped in the carbon 35 and return them to the machine cooler 12 by way of the solenoid valve 44. After ten minutes of operation, the single shot timer 66 turns off, the relay coil 62 is inactivated to open the contacts 69 and shut off the vacuum pump motor 67, and the cycle is complete.

It should be recognized that with the above described process, the carbon filter 35 in the container 36 does not return to its original state by virtue of the vacuum pumping process but rather continues to have a residual, high concentration of refrigerant contained therein. The operation of the vacuum pump 43 does, however reduce the concentration of refrigerant enough to thereby reactivate the carbon filter for the next cycle.

While the present invention has been disclosed with particular reference to a preferred embodiment thereof, the concepts of this invention are readily adaptable to other embodiments, and those skilled in the art may vary the structure thereof without departing from the essential spirit of the invention.

What is claimed:

1. In a refrigeration system having an evaporator, a condenser and a refrigeration circuit, an improved purge recovery system of the type having a purge chamber, a coil for condensing refrigerant in the purge chamber, and a vent circuit to remove non-condensable gases from the purge chamber, wherein the improvement comprises:

a filter disposed in the vent circuit for absorbing refrigerant which does not condense in the purge chamber; and filter reactivation means for a periodically removing a portion of the absorbed refrigerant from said filter and returning it to the refrigeration circuit.

2. An improved purge recovery system as set forth in claim 1 wherein said filter is comprised of a carbon material.

3. An improved purge recovery system as set forth in claim 2 wherein said carbon filter is composed of granular activated carbon.

4. An improved purge recovery system as set forth in claim 1 wherein said filter reactivation means comprises a vacuum pump having a suction fluidly connected to said filter and having a discharge fluidly connected to the refrigeration circuit.

5. An improved purge recovery system as set forth in claim 1 and including a compressor operably connected to the purge chamber to compress the gases therein so as to enhance the condensation of refrigerant.

6. An improved purge recovery system as set forth in claim 5 wherein said compressor takes a suction from the condenser.

7. An improved purge recovery system as set forth in claim 5 and including a valve between the purge chamber and said filter container.

8. A method of obtaining increased efficiency in removing non condensable gases from a refrigeration system by way of a purge chamber and vent circuit, wherein the improvement comprises the steps of:

providing a filter in the vent circuit;

passing the non-condensable gases, which are mixed with refrigerant that did not condense in the purge chamber, through said filter and allowing the refrigerant to be absorbed thereby; and periodically removing at least a portion of the absorbed refrigerant from said filter so as to reactivate the filter for a subsequent absorbing cycle.

9. An improved method as set forth in claim 8 wherein said step of removing refrigerant from said filter is accomplished by way of a vacuum pump.

10. A method as set forth in claim 8 and including an additional step of connecting a compressor to the purge chamber to compress the gases therein so as to enhance the condensation of refrigerant within the purge chamber.

11. An improved method of purging non-condensable gases from a refrigeration system containing an evaporator, a condenser and a purge chamber having a condenser coil, a mixed gas input line, a liquid refrigerant discharge line, and a mixed gas discharge line, comprising the steps of:

providing a filter which is capable of absorbing refrigerant;

causing a mixture of non-compressable gases and a compressable refrigerant from the mixed gas discharge line to pass into said filter such that substantially all of the refrigerant from the mixed gas is absorbed by said filter;

and periodically removing a portion of said absorbed refrigerant from said filter to reactivate said filter for a subsequent absorption cycle.

12. An improved method as set forth in claim 11 wherein said step of periodically removing a portion of said absorbed refrigerant is accomplished by way of a vacuum pump.

13. An improved method as set forth in claim 11 and including an additional step of compressing the gas in the purge chamber to thereby enhance the degree of condensation that occurs therein.

14. An improved method as set forth in claim 11 and including a step of providing a valve in said mixed gas discharge line and opening said valve to allow said mixture to pass into said carbon filter only after the pressure in said purge chamber reaches a predetermined level.

15. An improved method as set forth in claim 11 and including a step of providing a container for said carbon filter such that as said mixture passes into said carbon filter, the non-compressable gases tend to accumulate in said container.

16. An improved method as set forth in claim 15 and including a pressure sensing means for sensing the pressure within said container and further wherein the method includes the additional step of venting the container to the atmosphere when the pressure in the container reaches a first predetermined level.

17. An improved method as set forth in claim 16 and including a step of periodically removing a portion of said absorbed refrigerant only after the pressure in said container reaches a second predetermined level, lower than said first predetermined level.

* * * * *